United States Patent [19]

Christ et al.

[11] Patent Number: 4,903,509

[45] Date of Patent: Feb. 27, 1990

[54] APPARATUS FOR DRYING TEXTILE MATERIAL IN ROPE FORM

[75] Inventors: Wilhelm Christ, Michelbach; Hans-Ulrich von der Eltz, Frankfurt am Main, both of Fed. Rep. of Germany

[73] Assignee: Hoechst Aktiengesellschaft, Fed. Rep. of Germany

[21] Appl. No.: 158,205

[22] Filed: Feb. 19, 1988

Related U.S. Application Data

[60] Division of Ser. No. 43,643, Apr. 28, 1987, which is a continuation of Ser. No. 783,415, Oct. 10, 1985, abandoned, which is a continuation of Ser. No. 624,927, Jun. 27, 1984, abandoned.

[30] Foreign Application Priority Data

Jun. 30, 1983 [DE] Fed. Rep. of Germany ..... 3323506

[51] Int. Cl.[4] ..... D06B 3/28

[52] U.S. Cl. ..... 68/5 C; 68/20; 68/178

[58] Field of Search ..... 68/5 C, 20, 177, 178; 8/149.1, 152; 34/155, 156, 160

[56] References Cited

U.S. PATENT DOCUMENTS 3,921,420 11/1975 Aurich et al. ..... 68/5 C
3,949,575 4/1976 Turner et al. ..... 68/5 C
4,005,500 2/1977 Rayment ..... 68/5 C X

FOREIGN PATENT DOCUMENTS 1785141 12/1972 Fed. Rep. of Germany ..... 68/177

*Primary Examiner*—Philip R. Coe
*Attorney, Agent, or Firm*—Connolly and Hutz

[57] ABSTRACT

In industry there is, for economic reasons, an urgent need to be able to carry out the drying of moist textile material immediately after a completed wet-treatment in the same apparatus in which the preceding treatment operation was carried out.

According to the invention the problems arising in the case of textile materials treated in rope form on jet units are solved by evaporatively dewatering the textile material in rope form by means of the gaseous agent which in the case of fabric-advancing jet systems operated by flowing liquor, steam or hot air takes over the transport of the goods immediately after the wet-treatment and which acts on the textile material under a predetermined variable superatmospheric pressure, then cooling the circulating drive gas to condense out the absorbed moisture, and recirculating the air thus dried.

1 Claim, 2 Drawing Sheets

APPARATUS FOR DRYING TEXTILE MATERIAL IN ROPE FORM

CROSS-REFERENCE TO RELATED APPLICATIONS

The present application is a division of application Ser. No. 43,643, filed April 28, 1987, which is a continuation of application Ser. No. 783,415, filed October 10, 1985 (now abandoned), which in turn is a continuation of application Ser. No. 624,927, filed June 27, 1984 (now abandoned).

The present invention relates to a process for predrying or drying moist woven or knitted textile goods in rope form and to a purpose-built apparatus in which use is made of the jet principle and which also advances the fiber material through the plant.

Published European Patent Application No. 0,014,919 discloses subjecting textiles in rope form to wet-finishing, in particular dyeing, in jet piece-dyeing units. In this operation, the textile material, held together in rope form and moving past the jets, is set in circulation either by means of the treatment liquor circulating in the same direction as a result of the jet system or by means of a gas stream or steam-air mixture coming out of the jets and being directed under positive pressure at the fiber material. The main feature of this processing technique is thus that the cloth (in the continuous, endless form) is repeatedly moved through the machine by the kinetic energy conferred by the tangential application of a jet. Although in this form of processing, as mentioned above, the rope can be driven during the various stages of the treatment by alternate or combined flow of gas and liquid, thus permitting seamless transition from one dyeing operation to the next without the movement of the goods having to be stopped and under isothermal conditions, to date it was nevertheless necessary to stop the jets and hence the operation to allow the wet-treated goods to be removed from the dyeing jet and be dried on a separate unit of conventional type.

In terms of hardware, drying the textile material after wet-finishing is an essential operation. Ideally the drying systems should be able to dry the goods while they are in the same form as during the wet-finishing.

For instance, German Offenlegungsschrift 3,046,292 describes a process for drying textile material in web form wherein, within a vessel which is sealed off from the outside atmosphere, the moist cloth, while passing in continuous and open-width form through a plurality of pipe sections arranged end-to-end, is subjected to the action of a pressurized steam-air mixture flowing in its longitudinal direction. There is in addition the option, employed for special purposes, of the discontinuous drying of piece goods in web form loaded in batches into the dryer, which may take the form of a tumbler in which the material being dried is flung around without application of tension or pressure and the desired effect is obtained as a result of the intensive mechanical agitation.

If, on the other hand, the treated material to be dried is held on a support, there are various available drying systems, such as rapid package dryers or box dryers, which also differ in the way the heat is supplied to the textile material and the moisture is removed. Rapid and also intensive drying can be achieved as a rule if for example yarn on cross-wound packages or in similar compact form is subjected to a penetrating radial hot-air flow.

The efficiency of such a discontinuous drying method can be increased by performing the operation under the influence of reduced pressure. The advantage of the vacuum—of increasing the rate of evaporation by lowering the boiling point—can only be exploited to a limited extent in the case of rapid package dryers where the air is continuously sucked through the textile material, since the lower density of the inflowing warm air—a result of the vacuum—makes for inefficient transport of the heat to the packages. For this reason the evacuating phase and the heating-up phase are kept separate from each other in the technique described in German Auslegeschrift 1,902,306 and German Auslegeschrift 1,927,651.

However, in the case of the rapid package dryer it is also possible to make use of superatmospheric pressure conditions. Since in this embodiment, unlike in atmospheric pressure drying, the air used for the drying is circulated in a closed system, the heat contained in the air leaving the drying zone is not lost, so that more heat gets to the package for the same blower output. As a consequence of the greater quantity of heat in the air-stream before entry into the material to be dried, the air leaving the drying zone in a pressurized dryer is moister. This fact is usefully exploited in the case of yarn packages via the process described in German Offenlegungsschrift 2,616,280.

In both vacuum drying and pressure drying the respective measures can take place in the same vessel as the wet-finishing.

It is then the object of the present invention to develop a drying technique tailored specifically to the needs of jet apparatus, so that the wet-finishing plus the subsequent dewatering can be carried out in one operation without fabric transport having to be interrupted and so that the losses in time and thermal energy which were incurred as a result of the hitherto forced change of equipment can be avoided and the goods thus treated suffer no loss of quality as a consequence of the additional charging operation.

Experience in the field of steam-operated jet systems in correspondence with said European Patent Application No. 0,014,919 has shown that they ensure that the cloth is spread out efficiently and revealed that, owing to the high exit speed, such a jet stream in a pressurized circulation system strips sufficient water from the moist cloth, so that this flow principle can be used for partially or completely drying the textile in rope form.

The present invention accordingly provides a process for partially or completely drying endless ropes of woven or knitted textiles discontinuously circulating in jet piece-dyeing machines immediately after a wet-treatment for finishing the textile using the exhaust method and advancing the fiber material within the fully autonomous machine by actuating the jet system, which comprises, immediately after the wet-finishing and after discharging the treatment liquid from this preceding treatment operation, evaporatively dewatering down to a certain residual moisture content the wet-finished moist rope, now kept moving forward by a gas stream, on meeting and being surrounded by the drive gas, preferably a steam-air mixture, separately circulated in a separate circulation system within and connected to the same apparatus and compressed to a predetermined superatmospheric pressure, and then cooling the off-gas mixture resulting from the moisture absorption in the preceding measure down from a supersaturated into a dry saturated state while at the same time recondensing the moisture stripped from the textile material and removing said moisture from the circulation of the gaseous drying agent.

The chief advantage of the novel method is that a wet-finishing treatment can be immediately followed in the same apparatus by a predrying or drying of the bleached and/or dyed and/or finished rope. According to the invention there is no need for a separate pressure dryer, it being sufficient to equip an existing jet-dyeing machine with a few additional facilities. Further machinery can therefore be dispensed with. The fact that the finished material remains in the previously used apparatus represents an enormous saving in time. It is now no longer necessary to do a conversion. As the drying takes place in the sealed jet-dyeing machine, the resulting energy balance is also significantly more favorable, in particular since the required heat for vaporizing the moisture in the goods can be recovered, owing to the sealed system, as the heat of condensation of the not inconsiderable amounts of water condensed in the course of the cycle out of the air leaving the drying zone.

Furthermore, use of the process according to the invention even produces some appreciable improvements of the textile properties. Owing to the fact that the rope moves at high speed during the drying, the fiber is relaxed, which gives the material a very favorable hand and filling effect. In certain circumstances it is thus possible to save on hand finishes, such as softeners, stuffing agents and the like. Another particular advantage of the invention is that the cloth is displaced in the course of each cycle, so that no creases can form.

The novel idea underlying the claimed process is to utilize the gaseous drive means responsible for advancing the goods also for the purpose of dewatering the goods, i.e. to use, so to speak, the gas as a pressure dryer. In this function, the circulated drying medium—as when used purely for transporting the goods—is guided tangentially to the transport direction of the goods and at the same time flows around the textile in rope form and dries it—depending on the air speed and the nature of the moisture bond to the substrate—not only mechanically, by getting into the fiber and shaking the water loose, but also thermally, by evaporating the moisture on the goods.

The heat required for heating up the textile materials in rope form is preferably extracted from a steam-air mixture. This drying agent flows in a cycle within a closed system, set in motion by the output of a blower and compressed by the same to the back-pressure necessitated by the amount of air. The total pressure difference which the compressor has to overcome is equal to the total of all the resistances encountered by a volume of gas flowing through the circulation system, including the goods. Since the present invention relates to a form of evaporative drying and in order to achieve the desired rate of drying, the steam-air mixture is not only imparted with kinetic energy through the work of the compressor but also with thermal energy, through an air heater which is installed in the circulation system on the pressure side of the compressor. The heat transfer to the continuously moving textile material predominantly takes place within the jet section and the downstream transport section onto which the textile material is accompanied by the gaseous heating medium. Sufficient contact between the drying air and the rope of textile material is ensured by the fact that the material to be dried, which is not especially brought into open-width form, is a quasi open surface having correspondingly free interspaces. More comprehensive penetration of the rope by the drying air in the course of the passage of the rope through the drying zone is favored by the fact that the packing density of the rope is loosened up to a certain extent by the preceding passage past the jet. The outward moisture transport in the interior of the textile material is due to capillary forces at first and proceeds via vapor diffusion in the later stages of the drying process, since at this point there is a moisture content and temperature difference compared with the surface. The momentum imparted by the flowing gas to the textile material, which results in the textile material moving forward in a cycle inside the machine, is utilized for the thermal drying in the claimed process. The thermodynamics of the drying agent within the jet and its change in state on the way to the intake port of the compressor can be depicted in a moist air diagram.

As already mentioned above, according to the invention the wet-finishing of the fiber material in rope form is immediately followed by its drying in the same apparatus. However, it is also perfectly conceivable that, following a partial dewatering carried out as described, the cloth is introduced by means of the compressor attached to the jet-dyeing machine into a separate dryer having a plurality of sealable compartments.

The drying process according to the present invention proceeds as follows: to bring the wet-finished material to a desired residual moisture content, be it by partial dewatering/predrying or complete drying, the unit loaded with the moist textile material is sealed off from the circulating liquor, and the compressor is switched on. As a result, the entire system is under a predetermined superatmospheric pressure, and there is an increase in the density, the speed of flow and also the kinetic energy of the steam-air mixture. As a result of the increased kinetic energy, the water adhering to the textile material is stripped off in the form of very fine droplets.

The moisture transferred into the gas space and taken up by the gas stream is then carried away from the rotating rope in this way, and the resulting moist air mixture is removed from the treatment zone at the end of the joint transport section and is subjected to drying measures. The moisture-supersaturated leaving air is recooled, to separate out the moisture, to the recooling temperature limit defined by the respective drying method, in an air cooler. The moisture which condenses as the temperature passes through the dew point coalesces in the downstream water separator, whereupon the gaseous medium thus dried is again returned to the circulation system, compressed and heated up, and is again brought to bear on the moist rope material.

In the textile industry it is at present customary not to dewater completely those goods which, for example, are further finished after having been dyed. In many cases a certain residual moisture content is even desirable. According to the process of the invention, it is now perfectly feasible to control the drying in the jet-dyeing apparatus in such a way that the goods—irrespective of the type of fabric—are conditioned at the same time. This can be put into effect by dewatering the rope within the sealed dyeing jet to a moisture content equilibrium state which on removing the textile material from the unit and cooling it down corresponds to the conditioning moisture content thereof, or by dewatering the rope within the sealed dyeing jet down to below the conditioning moisture level and then conditioning the textile material by increasing the relative moisture content of the drying air. The last-mentioned principle of moistening by means of conditioned air of a certain temperature and a certain moisture content is utilized on a similar basis in German Offenlegungesschrift 2,052,440 in the conditioning of yarn packages made of hygroscopic fiber material for equalizing the different moisture levels between the inner and outer layers of the wound yarn packages.

In an apparatus which is suitable for carrying out the claimed process and which is also part of the subject-matter of the present invention, a conventionally desiged jet-dyeing machine which is suitable for the hydraulic propulsion of textiles in endless rope form by means of a treatment liquid is connected to a separate circulation system in which a gas stream is optionally supporting or solely responsible for the fabric transport and in which are present, arranged in the stated order, means for compressing the gaseous medium and subsequently heating it up, a contact section for the drive gas and the circulating textile material which is effective from a built-in jet arrangement for the fabric transport onward, means for recooling the resulting gas stream and removing moisture therefrom, and means for separating off the resulting condensate.

BRIEF DESCRIPTION OF THE DRAWING

Novel features and advantages of the present invention in addition to those enumerated above will become apparent from a reading of the following detailed description in conjunction with the accompanying drawing wherein.

Figure 1:
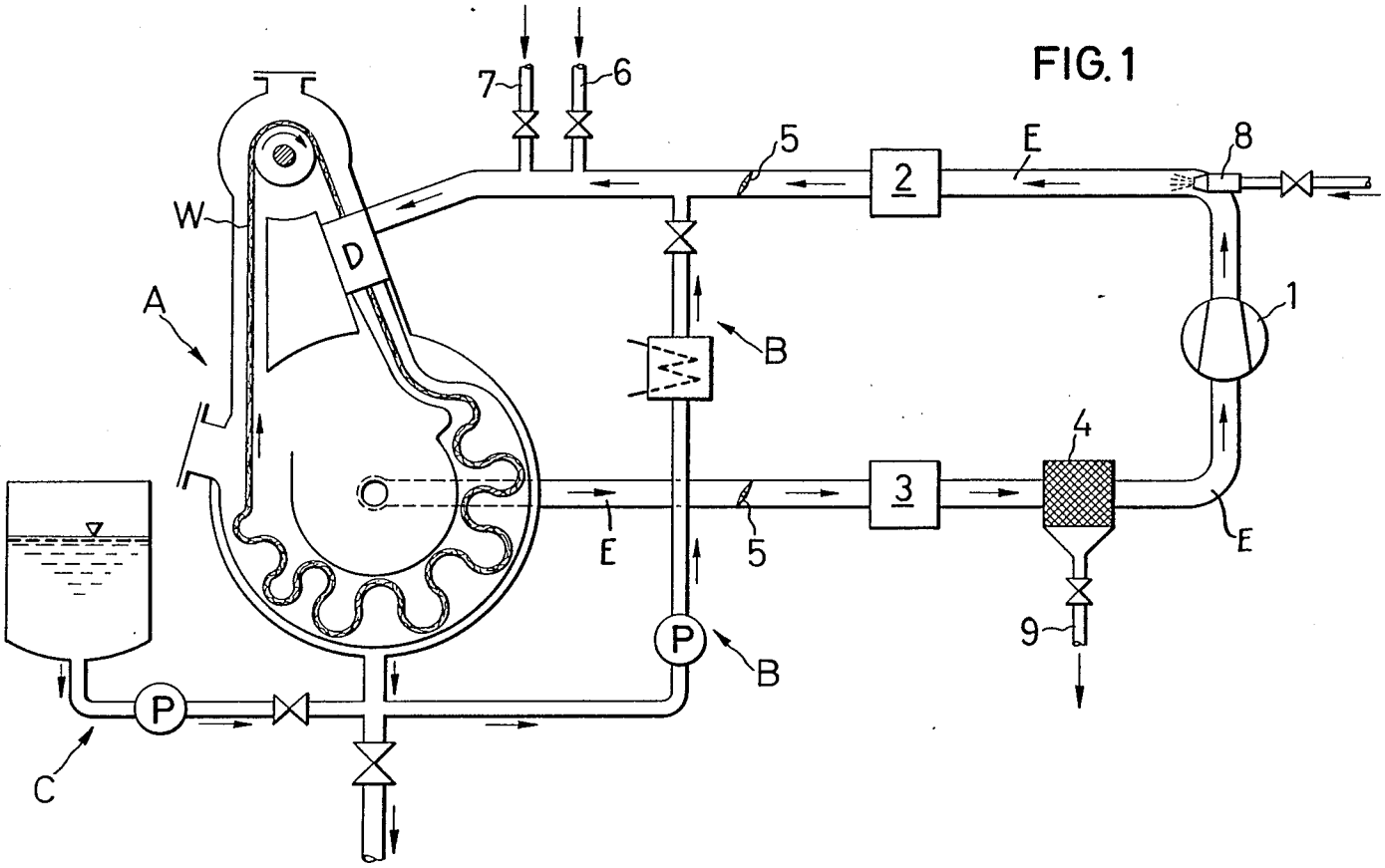
FIG. 1 is a schematic view of a jet-dyeing machine with textile drying structure, according to the present invention

An illustrative embodiment of a jet-dyeing machine used according to the invention is schematically depicted in cross-section in the drawing of FIG. 1 given below. The reference symbols used in the drawing are identical to the numerals used in the text for the same purpose and are defined as follows:

A=a jet-dyeing machine (pressure vessel) comprising drive portion (winch), transport jet and fabric storage space plus discharge (not numbered)

B=liquor circulation system comprising circulation pump and heat exchanger for heating and cooling with downstream throttling device for regulating the liquor flow (not numbered)

C=make-up and stock reservoir vessel for treatment liquids, with downstream metering pump and seal-off valve (not numbered)

D=jet section, optionally allowing hydraulic or aerodynamic advance of the textile rope E=separate gas circulation system which in case of operation is standing under predetermined excess pressure P=pumps for feeding circulation B with liquor, or for maintaining the said circulation of B W=material to be treated/textile rope 1=blower (compressor)

2=air heater

3=air cooler (condenser)

4=trap for the moisture from the circulating air

5=seal-off flaps

6=compressed air connection (gas connection)

7=steam connection

8=injection nozzle for water (possible admixture of finishing products)

9=condensed moisture outflow.

In this FIG. 1 the parts of the jet-dyeing machine which are signified by the letters A, B and C largely correspond to the prototype of such an apparatus described in detail in U.S. Pat. No. 3,949,575.

The claimed apparatus operates in principle as follows:

Immediately following a wet-finishing treatment under the action of hydraulically effective circulation system B (with the circulation pump P in motion and closed seal-off flaps 5) with the treatment liquor containing the finishing agent and fed in from stock reservoir vessel C and after the fabric storage space has been emptied of the largely exhausted liquid medium, the two seal-off flaps 5 are opened for the circulation of the gaseous drying agent and blower 1 is switched on, so as to dry or partially dewater the textile rope W circulating in unchanged form in jet-dyeing machine A. As a result of introducing compressed air from a not depicted compressed air source via connection 6 to fill up for the first time the cyclic path E for the gaseous drying agent, which comprises dyeing jet A, now serving as drying vessel, air cooler 3, water trap 4, blower 1 and air heater 2, which are connected to each other via a line, an intentional superatmospheric pressure for the propelling air steam of, for example, about 2.5 bar arises in the overall system. The density of the gas present thus rises and, as a result, the total pressure difference prevailing at blower 1 increases, as does consequently also the weight of flowing air per second. There is a similar increase in the speed of flow, and the kinetic energy of the steam-air mixture increases as a consequence. The surface moisture is detached from the textile material and is carried away, so to speak, as a mist of very fine water droplets in the gas stream acting as a vehicle. The intensity of this drying section corresponds to that of a mechanical dewatering obtained in a centrifuge, but in this case the goods are dried without creasing.

To make available for drying the moving rope W thermal energy as well and thus to support the moisture-removing swirling effect of the airflow, the gaseous drying agent, compressed in blower 1 to the back-pressure necessitated by the amount of air, is heated up to a predetermined drying temperature in downstream air heater 2, and the moisture on the goods is thus gradually evaporated by the heat contained in the drying air. The air used as the operating gas for the circulation system of the drying agent in the process can preferably also be replaced by a hot steam-air mixture by supplying the steam by way of connection 7.

At the end of the joint contact section of the gaseous-drying agent and circulating rope W, the high-moisture steam-air mixture emerging from drying vessel A (dyeing jet) is cooled down to the proposed temperature as it passes through an air cooler 3, whereupon the supersaturated water present in the emerging air condenses in a downstream trap 4 and is removed by way of outflow 9. The virtually anhydrous drying air or the dry saturated steam-air mixture leaving water trap 4 is then again attracted and compressed by means of blower 1 and, after subsequent warming up in air heater 2, is again passed into and through drying vessel A to act on goods W.

To condition the textile material, the machine system is targeted at the predetermined state values of the moist-air mixture, and a predetermined amount of water per unit time is atomized by injection nozzle 8 for a certain time in the circulation system. This will advantageously take place when the desired dryness has been approximately obtained.

Figure 2:
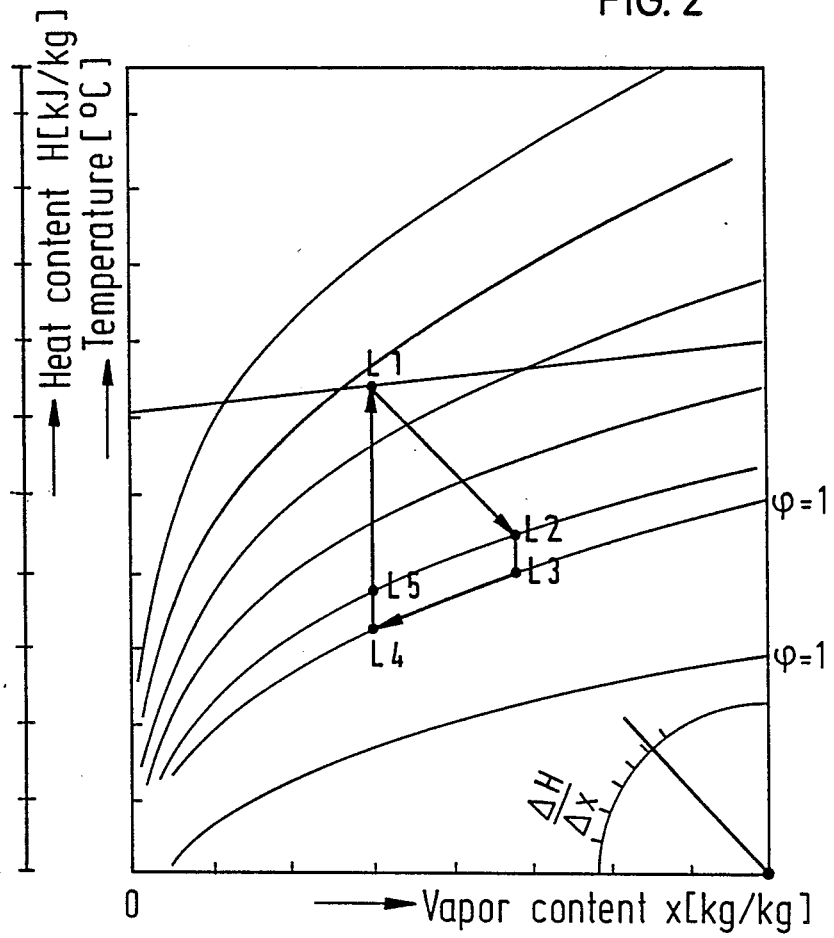
FIG. 2 is a graphical representation of the drying sequence utilizing the machine of FIG. 1.

To illustrate the thermodynamics of the drying process according to the invention, a simplified graphical representation of the drying sequence for a certain drying section is reproduced as an example in FIG. 2 in the form of a moist air H(x) diagram with plane rectangular coordinates:

The circulating steam-air mixture of state L1 meets the moist goods inside the transport jet of the jet-dyeing machine. For the purposes of entering it in the coordinate system, state L1 can be characterised by the values heat content H, vapor or moisture content x and temperature. The drying air then flows into contact with the goods to be dried from the jet over a common transport section and the fabric store to the exit point out of the drying vessel. Said state L1 of the drying air changes approximately along a straight line whose direction can be drawn in on the basis of the $\Delta H/\Delta x$ scale in the margin if account is taken of the temperature of the goods at the constant state. Drying air state L2 represents the conditions at the exit from the fabric store, as a function of the drying sequence. As a result of the drying air acting on the rope and cooling down to state L2, the corresponding transfer of heat to the textile material is accompanied at the same time by an absorption of moisture by the drying air, occasioned by dewatering of the goods brought about during this treatment phase. As the now high-moisture drying air is recooled in air cooler 3 after separation from the rope material accompanied up to then no change in the moisture content of the leaving air is initially recorded until dew point line $\gamma=1$ (saturation line) in state point L3 is reached. Only as the recooling temperature is lowered further is the supersaturated water content present in the gaseous drying agent released, which, in the diagram, takes the form of a change in direction in the drying sequence in the sense of shifting the state point for the drying air toward the left-hand side along the saturation line toward state L4. This shift is accompanied by a reduction of the moisture content of the drying air, owing to condensation, by the amount of $x_3-x_4$ kg of moisture per kg of dry air. This amount of moisture is separated from the drying air in trap 4 and is passed out of the machine. Said state L4 of the drying air characterises its state at the intake port of blower 1, and in the course of the subsequent compression the drying air is heated by the amount of the work of compression to state L5 while the moisture content remains unchanged. The subsequent section from state L5 to state L1 then reveals the amount of heat transferred to the drying air by heat transfer from air heater 2. As the vapor-air mixture is heated from saturation state in point L4 to the starting state of the cycle in point L1 the moisture content x remains constant, so that the change in state is depicted by a vertical line.

State L2 in the diagram explained in the preceding paragraph as a rule corresponds to the result of the interaction of the influences of two quantities of moist air constituted by the quantity which flows from the compressor into the jet and the quantity which is sucked into the jet together with the goods.

We claim:

1. Apparatus for wet finishing and at least partially drying endless ropes of textiles consisting essentially of a machine for wet finishing the rope with a treatment liquid, jet means within the machine for propelling treatment liquid through the machine and thereby hydraulically moving the rope through the machine by the treatment liquid, a treatment liquid circulation system connected to receive treatment liquid discharged from the machine and to supply treatment liquid to the machine, means feeding treatment liquid into the circulation system, means for removing treatment liquid from the machine, a gas circulation system separate from the treatment liquid circulation system connected to supply drying gas to the machine at the jet means therein after treatment liquid is removed therefrom and to receive spent gas discharged from the machine, the gas circulation system additionally including cooling means for lowering the temperature of the circulating spent gas thereby causing moisture to precipitate from that gas, means for removing moisture from the spent gas, blower means for compressing the circulated gas in the system, and heating means for elevating the temperature of the gas supplied to the machine at the jet means whereby the drying gas is propelled through the machine to aerodynamically move and at least partially dry the treated rope by removing moisture therefrom.

* * * * *